US010607528B2

(12) United States Patent
Zeng

(10) Patent No.: US 10,607,528 B2
(45) Date of Patent: Mar. 31, 2020

(54) METHOD FOR DRIVING DISPLAY PANEL AND DISPLAY DEVICE

(71) Applicants: HKC Corporation Limited, Shenzhen (CN); Chongqing HKC Optoelectronics Technology Co., ltd., Chongqing (CN)

(72) Inventor: Dekang Zeng, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/141,120

(22) Filed: Sep. 25, 2018

(65) Prior Publication Data

US 2019/0027085 A1 Jan. 24, 2019

Related U.S. Application Data

(63) Continuation of application No. PCT/CN2017/106751, filed on Oct. 18, 2017.

(30) Foreign Application Priority Data

Jun. 29, 2017 (CN) ..... 2017 1 0517069

(51) Int. Cl.

| | |
|---|---|
| ***G09G 3/36*** | (2006.01) |
| ***G09G 3/30*** | (2006.01) |
| ***G09G 3/20*** | (2006.01) |

(52) U.S. Cl.

CPC ..... *G09G 3/2074* (2013.01); *G09G 3/20* (2013.01); *G09G 3/3611* (2013.01); (Continued)

(58) Field of Classification Search

CPC .. G09G 3/36; G09G 3/30; G09G 5/10; G09G 5/02; G06K 9/00; G06T 5/002; G06T 5/00

See application file for complete search history.

(56) References Cited

U.S. PATENT DOCUMENTS

2005/0122441 A1* 6/2005 Shimoshikiryoh ..... G02F 1/13624 349/38

2011/0069061 A1* 3/2011 Nakamura ..... G09G 3/3225 345/214

(Continued)

*Primary Examiner* — Pegeman Karimi

(74) *Attorney, Agent, or Firm* — WPAT, PC

(57) ABSTRACT

A method for driving a display panel includes obtaining a gray scale value and an abscissa value of a current sub-pixel, compensation gain values and coordinate values of boundary lines of each interval, a gray scale value of a sub-pixel of a previous row; performing a query in a gray scale lookup table according to the gray scale value of the current sub-pixel and the gray scale value of the sub-pixel of the previous row of the display panel to obtain an initial gray scale value of the current sub-pixel, performing a calculating to obtain a gray scale variation compensation value of the current sub-pixel; obtaining an interval of the current sub-pixel located; performing the calculating to obtain a compensation value of the interval of the current sub-pixel located; and obtaining and outputting a final compensation gray scale value of the current sub-pixel by performing a linear interpolation.

20 Claims, 6 Drawing Sheets

(52) U.S. Cl.
CPC ..... *G09G 2320/029* (2013.01); *G09G 2320/0242* (2013.01); *G09G 2320/0285* (2013.01); *G09G 2340/16* (2013.01); *G09G 2360/16* (2013.01)

(56) References Cited

U.S. PATENT DOCUMENTS

2015/0042688 A1* 2/2015 Kim ..... G09G 3/3208 345/690
2018/0031876 A1* 2/2018 Liu ..... G02F 1/1309

* cited by examiner

METHOD FOR DRIVING DISPLAY PANEL AND DISPLAY DEVICE

RELATED APPLICATIONS

This application is based upon and claims the benefit of priority from Chinese Patent Application No. 2017105170695 filed on Jun. 29, 2017, entitled "METHOD FOR DRIVING DISPLAY PANEL AND DISPLAY DEVICE", the entire contents of which are incorporated herein by reference.

FIELD OF THE DISCLOSURE

The disclosure relates to a display panel technical field, and more particularly to a method for driving display panel and a display device.

BACKGROUND

In the design of the pixel display matrix of the thin film transistor liquid crystal display, It is necessary to carry out a centralized fan-shaped wiring process for a bonding region of a driving integrated circuit, since the distances outputted from the driving integrated circuit to each of the display traces are different, so that the align of the resistance of the fan-shaped region cannot be achieved, thus causing the delay degree of the voltage change of each display traces is not the same, finally make the charging time of each display traces is not consistency and causing color shift, the more the outputting routes of the driving integrated circuit, the more the resistance difference of the fan-out traces in the fan-shaped region, the even more of the delay degree of the voltage change of each display traces, and more seriously color shift.

Conventionally, by usually adapting changing the material of the display traces to reduce the difference of the resistance of the traces, or by reducing the number of the outputting routes of the driving integrated circuit to reduce the interval of the fan-shaped region, by reducing the distance difference of the display traces to reduce the difference of the resistance of the traces. But changing the material of the display traces, the support of the TFT-LCD process is needed, and the change of the process and the issues dealing with the process yield will raise a great cost problem, and reducing the number of the outputting routes of the driving integrated circuit will be corresponding increasing the number of the driving integrated circuit, and leading to increase costs, so the conventional method for improving color shift is costly.

SUMMARY

According to various embodiments disclosed in the present application, a method for driving a display panel and a display device is provided.

A method for driving the display panel including the steps of:

Obtaining a gray scale value of a current sub-pixel of a display panel, an abscissa value of the current sub-pixel, compensation gain values of boundary lines of each interval, coordinate values of the boundary lines of each interval, and a gray scale value of a sub-pixel of a previous row of the display panel;

Performing a query in a gray scale lookup table according to the gray scale value of the current sub-pixel of the display panel and the gray scale value of the sub-pixel of the previous row of the display panel to obtain an initial gray scale value of the current sub-pixel, performing a calculating to obtain a gray scale variation compensation value of the current sub-pixel according to the initial gray scale value of the current sub-pixel and the gray scale value of the current sub-pixel;

Obtaining an interval of the current sub-pixel located according to the abscissa value of the current sub-pixel and the coordinate values of the boundary lines of each interval;

Performing a calculating to obtain a compensation value of the interval of the current sub-pixel located according to the compensation gain value of the adjacent boundary lines of the interval of the current sub-pixel located and the gray scale variation compensation value of the current sub-pixel; and Obtaining and outputting a final compensation gray scale value of the current sub-pixel by performing a linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel.

In one embodiment, the step of performing a calculating to obtain the gray scale variation compensation value of the current sub-pixel according to the initial gray scale value of the current sub-pixel and the gray scale value of the current sub-pixel specifically is:

$$\Delta V = V2 - V1; \text{ and}$$

Wherein ΔV is the gray scale variation compensation value of the current sub-pixel, V2 is the initial gray scale value of the current sub-pixel, and V1 is the gray scale value of the current sub-pixel.

In one embodiment, the step of obtaining the interval of the current sub-pixel located according to the abscissa value of the current sub-pixel and the coordinate values of the boundary lines of each interval, includes:

Comparing the abscissa value of the current sub-pixel with the coordinate values of the boundary lines of each interval, when the current sub-pixel located between the boundary lines of two adjacent intervals, the current sub-pixel disposed in the interval between the boundary lines of two adjacent intervals.

In one embodiment, the step of performing a calculating to obtain the compensation value of the interval of the current sub-pixel located according to the compensation gain value of the adjacent boundary lines of the interval of the current sub-pixel located and the gray scale variation compensation value of the current sub-pixel, includes:

Performing a calculating to obtain a first compensation value and a second compensation value according to the gray scale variation compensation value of the current sub-pixel and the compensation gain value of the adjacent boundary lines of the interval of the current sub-pixel located; and Performing a calculating to obtain the compensation value of the interval of the current sub-pixel located according to the first compensation value and the second compensation value.

In one embodiment, the step of performing a calculating to obtain the first compensation value and the second compensation value according to the gray scale variation compensation value of the current sub-pixel and the compensation gain value of the adjacent boundary lines of the interval of the current sub-pixel located, specifically is:

$$\Delta Vi = \Delta V * Ai;$$

$$\Delta V(i+1) = \Delta V * A(i+1); \text{ and}$$

Wherein ΔVi is the first compensation value, ΔV(i+1) is the second compensation value, ΔV is the gray scale variation compensation value of the current sub-pixel, Ai is the compensation gain value of the boundary line of I interval, A(i+1) is the compensation gain value of the boundary line of I+1 interval.

In one embodiment, the step of performing a calculating to obtain the compensation value of the interval of the current sub-pixel located according to the first compensation value and the second compensation value, specifically is:

$$\Delta Va=\Delta V(i+1)-\Delta Vi;\text{ and}$$

Wherein ΔVa is the compensation value of the interval of the current sub-pixel located, ΔV(i+1) is the second compensation value, and ΔVi is the first compensation value.

In one embodiment, the step of obtaining and outputting the final compensation gray scale value of the current sub-pixel by performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel, includes:

Performing a calculating to obtain a first coordinate value according to the coordinate values of the adjacent boundary lines of the interval of the current sub-pixel located;

Performing a calculating to obtain a ratio value according to the abscissa value of the current sub-pixel and the first coordinate value;

Performing a calculating to obtain a compensation value of the current sub-pixel according to the ratio value and the compensation value of the interval of the current sub-pixel located; and Performing a calculating to obtain and output the final compensation gray scale value of the current sub-pixel according to the gray scale value of the current sub-pixel and the compensation value of the current sub-pixel.

In one embodiment, the step of performing a calculating to obtain the first coordinate value according to the coordinate values of the adjacent boundary lines of the interval of the current sub-pixel located, specifically is:

$$X=A+B;\text{ and}$$

Wherein X is the first coordinate value, A is the coordinate value of the boundary line of I interval, and B is the coordinate value of the boundary line of I+1 interval.

In one embodiment, the step of performing a calculating to obtain the ratio value according to the abscissa value of the current sub-pixel and the first coordinate value, specifically is:

$$Z=Y/X;\text{ and}$$

Wherein Z is the ratio value, Y is the abscissa value of the current sub-pixel, and X is the first coordinate value.

In one embodiment, the step of performing a calculating to obtain the compensation value of the current sub-pixel according to the ratio value and the compensation value of the interval of the current sub-pixel located, specifically is:

$$\Delta V1=\Delta Va*Z;\text{ and}$$

Wherein ΔV1 is the compensation value of the current sub-pixel, ΔVa is the compensation value of the interval of the current sub-pixel located, and Z is the ratio value.

In one embodiment, the step of performing a calculating to obtain and output the final compensation gray scale value of the current sub-pixel according to the gray scale value of the current sub-pixel and the compensation value of the current sub-pixel, specifically is:

$$\Delta V2=\Delta V1+V1;\text{ and}$$

Wherein ΔV2 is the final compensation gray scale value of the current sub-pixel, ΔV1 is the compensation value of the current sub-pixel, and V1 is the gray scale value of the current sub-pixel.

A display panel driving device, including a storage module and a processing module, the storage module storing a computer executable instruction, the storage module including an acquisition module, a query module, a determination module, a calculation module, and a linear interpolation module, wherein when an executable instruction is executed by the processing module, making the processing module to execute the functions of the acquisition module, the query module, the determination module, the calculation module and the linear interpolation module;

The acquisition module configured to acquire a gray scale value of a current sub-pixel of a display panel, an abscissa value of the current sub-pixel, compensation gain values of the boundary lines of each interval, coordinate values of the boundary lines of each interval, and a gray scale value of a sub-pixel of a previous row of the display panel;

The query module configured to perform a query in a gray scale lookup table, to obtain an initial gray scale value of the current sub-pixel, according to the gray scale value of the current sub-pixel of the display panel and the gray scale value of the sub-pixel of the previous row of the display panel, to perform a calculating to obtain a gray scale variation compensation value of the current sub-pixel according to the initial gray scale value of the current sub-pixel and the gray scale value of the current sub-pixel;

The determination module configured to obtain an interval of the current sub-pixel located according to the abscissa value of the current sub-pixel and the coordinate values of the boundary lines of each interval;

The calculation module configured to perform a calculating to obtain a compensation value of the interval of the current sub-pixel located according to the compensation gain value of the adjacent boundary lines of the interval of the current sub-pixel located and the gray scale variation compensation value of the current sub-pixel; and The linear interpolation module configured to perform a linear interpolation according to the gray scale value of the current sub-pixel, the compensation value of the interval of the current sub-pixel located, the coordinate values of the adjacent boundary lines of the interval of the current sub-pixel located, and the abscissa value of the current sub-pixel to obtain and output a final compensation gray scale value of the current sub-pixel.

In one embodiment, the determination module configured to obtain the interval of the current sub-pixel located according to the abscissa value of the current sub-pixel and the coordinate values of the boundary lines of each interval, including:

Comparing the abscissa value of the current sub-pixel with the coordinate values of the boundary lines of each interval, when the current sub-pixel located between the boundary lines of two adjacent intervals, the current sub-pixel disposed in the interval between the boundary lines of two adjacent intervals.

In one embodiment, the calculation module configured to perform a calculating to obtain the compensation value of the interval of the current sub-pixel located according to the compensation gain value of the adjacent boundary lines of the interval of the current sub-pixel located and the gray scale variation compensation value of the current sub-pixel, including:

A first calculation module is configured to perform a calculating to obtain a first compensation value and a second compensation value according to the gray scale variation compensation value of the current sub-pixel and the compensation gain value of the adjacent boundary lines of the interval of the current sub-pixel located; and A second calculation module is configured to perform a calculating to obtain the compensation value of the interval of the current sub-pixel located according to the first compensation value and the second compensation value.

In one embodiment, the linear interpolation module configured to perform the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel to obtain and output the final compensation gray scale value of the current sub-pixel, including:

A first coordinate value calculation module is configured to perform a calculating to obtain the first coordinate value according to the coordinate values of the adjacent boundary lines of the interval of the current sub-pixel located;

A ratio value calculation module is configured to perform a calculating to obtain the ratio value according to the abscissa value of the current sub-pixel and the first coordinate value;

A compensation value calculation module is configured to perform a calculating to obtain the compensation value of the current sub-pixel according to the ratio value and the compensation value of the interval of the current sub-pixel located; and A final compensation gray scale value calculation module is configured to perform a calculating to obtain and output the final compensation gray scale value of the current sub-pixel according to the gray scale value of the current sub-pixel and the compensation value of the current sub-pixel.

A method for driving a display panel, including the steps of:

Obtaining a gray scale value of a current sub-pixel of a display panel, an abscissa value of the current sub-pixel, compensation gain values of the boundary lines of each interval, coordinate values of the boundary lines of each interval, and a gray scale value of a sub-pixel of a previous row of the display panel;

Performing a query in a gray scale lookup table according to the gray scale value of the current sub-pixel of the display panel and the gray scale value of the sub-pixel of the previous row of the display panel to obtain an initial gray scale value of the current sub-pixel, performing a calculating to obtain a gray scale variation compensation value of the current sub-pixel according to the initial gray scale value of the current sub-pixel and the gray scale value of the current sub-pixel;

Comparing the abscissa value of the current sub-pixel with the coordinate values of the boundary lines of each interval, when the current sub-pixel located between the boundary lines of two adjacent intervals, the current sub-pixel disposed in the interval between the boundary lines of two adjacent intervals;

Performing a calculating to obtain a first compensation value and a second compensation value according to the gray scale variation compensation value of the current sub-pixel and the compensation gain value of the adjacent boundary lines of the interval of the current sub-pixel located; and Obtaining and outputting a final compensation gray scale value of the current sub-pixel by performing a linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel.

In one embodiment, the step of obtaining and outputting the final compensation gray scale value of the current sub-pixel by performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel, includes:

Performing a calculating to obtain a first coordinate value according to the coordinate values of the adjacent boundary lines of the interval of the current sub-pixel located;

Performing a calculating to obtain a ratio value according to the abscissa value of the current sub-pixel and the first coordinate value;

Performing a calculating to obtain a compensation value of the current sub-pixel according to the ratio value and the compensation value of the interval of the current sub-pixel located; and Performing a calculating to obtain and output the final compensation gray scale value of the current sub-pixel according to the gray scale value of the current sub-pixel and the compensation value of the current sub-pixel.

In one embodiment, the step of performing a calculating to obtain the first coordinate value according to the coordinate values of the adjacent boundary lines of the interval of the current sub-pixel located, specifically is:

$$X=A+B; \text{ and}$$

Wherein X is the first coordinate value, A is the coordinate value of the boundary line of I interval, and B is the coordinate value of the boundary line of I+1 interval.

In one embodiment, the step of performing a calculating to obtain the ratio value according to the abscissa value of the current sub-pixel and the first coordinate value, specifically is:

$$Z=Y/X; \text{ and}$$

Wherein Z is the ratio value, Y is the abscissa value of the current sub-pixel, and X is the first coordinate value.

In one embodiment, the step of performing a calculating to obtain the compensation value of the current sub-pixel according to the ratio value and the compensation value of the interval of the current sub-pixel located, specifically is:

$$\Delta V1=\Delta Va*Z; \text{ and}$$

Wherein ΔV1 is the compensation value of the current sub-pixel, ΔVa is the compensation value of the interval of the current sub-pixel located, and Z is the ratio value.

The method for driving the display panel and the display device are according to the gray scale value of the current sub-pixel of the display panel and the gray scale value of the sub-pixel of the previous row of the display panel, performing a query in the gray scale lookup table, to obtain the initial gray scale value of the current sub-pixel, performing a calculating to obtain the gray scale variation compensation value of the current sub-pixel according to the initial gray scale value of the current sub-pixel and the gray scale value of the current sub-pixel, performing a calculating to obtain the compensation value of the located interval according to the compensation gain value of the adjacent boundary lines of the located interval and the gray scale variation compensation value of the current sub-pixel, and finally obtaining the compensation value of the current sub-pixel by performing the linear interpolation by performing the calculating to obtain the final compensation gray scale value of the current sub-pixel according to the gray scale value of the current sub-pixel and the compensation value of the current sub-pixel, in the premise of not increasing the cost, effectively improving the color shift, and enhancing the optical taste of the display device.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
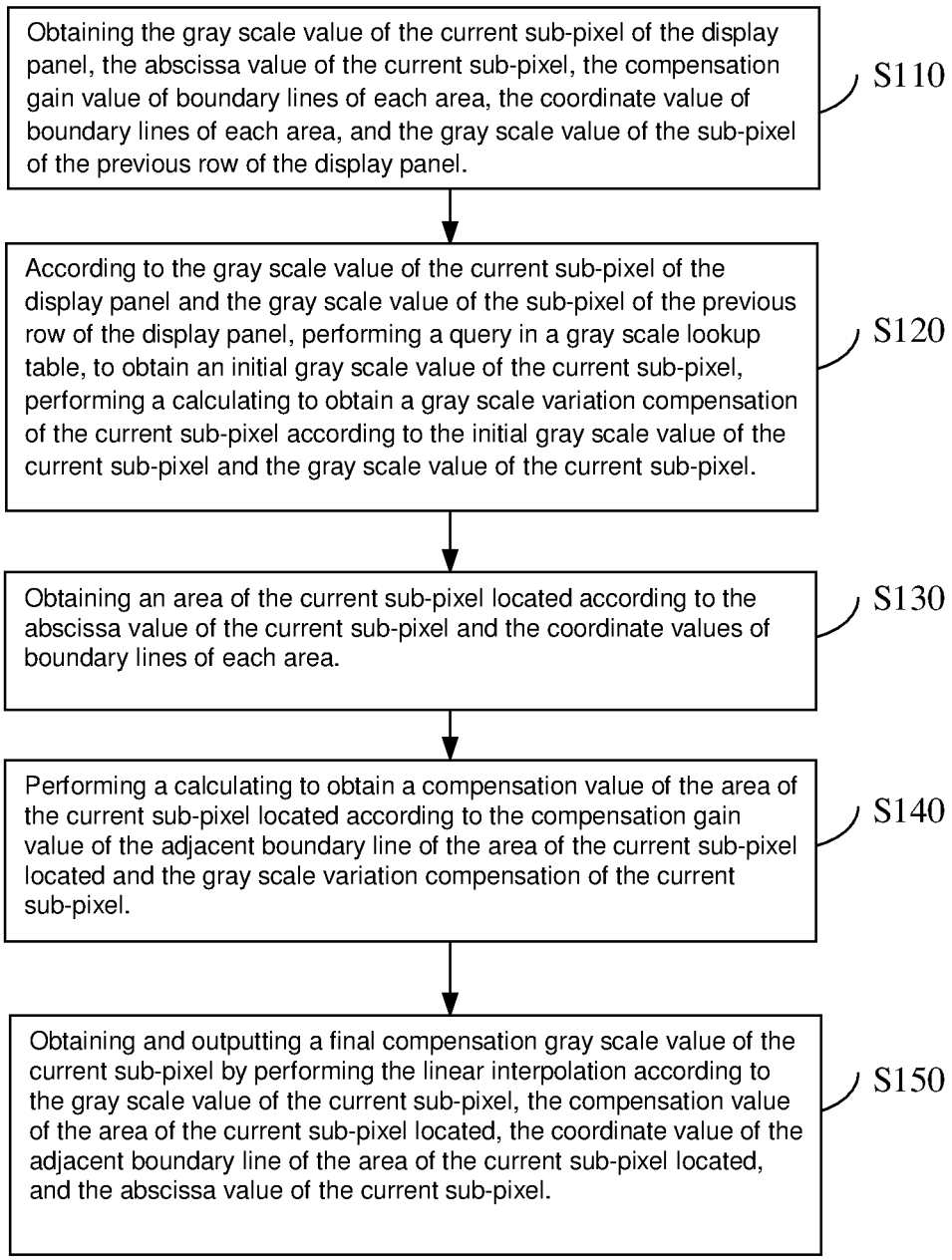
FIG. 1 is a flow chart of a method for driving the display panel provided by an embodiment.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

In the following, structures of display panels associated with the disclosure will be described with reference to FIG. 1 through FIG. 6.

In one embodiment, as shown in FIG. 1, a method for driving the display panel includes the steps of:

Step S110: Obtaining the gray scale value of the current sub-pixel of the display panel, the abscissa value of the current sub-pixel, the compensation gain value of each interval boundary line, the coordinate value of each interval boundary line, and the gray scale value of the sub-pixel of the previous row of the display panel.

Specifically, the compensation gain value for each interval boundary line is obtained by combining the actual panel type and commissioning measurements. The corresponding relationship between the sub-pixel of the previous row and the current sub-pixel is a previous compensated sub-pixel compared to the current sub-pixel when the grayscale compensation is performed in a preset direction and a preset order. In the present embodiment, the display panel performs the color shift compensation by intervals, for example from one end of the display panel to the other, and the compensation is performed from the left side of the display panel. After the compensation of point A, the current point B is started to be compensated, so that Point A is the sub-pixel of the previous row for point B, the gray scale value of the sub-pixel of the previous row of the display panel is the outputted gray scale value of the compensated point A.

Step S120: performing a query in a gray scale lookup table according to the gray scale value of the current sub-pixel of the display panel and the gray scale value of the sub-pixel of the previous row of the display panel, to obtain an initial gray scale value of the current sub-pixel, performing a calculating to obtain a gray scale variation compensation value of the current sub-pixel according to the initial gray scale value of the current sub-pixel and the gray scale value of the current sub-pixel.

Specifically, for example, the gray scale value V1 of the current sub-pixel of the display panel is 96, the gray scale value of the sub-pixel of the previous row is 0, the initial gray scale value V2 of the current sub-pixel is 99 obtained by querying the preset gray scale lookup table. Specifically, the gray scale lookup table is the preset gray scale lookup table, the values in the preset gray scale lookup table can be adjusted according to the different types of the display panels. The gray scale lookup table only needs a 9*9 table, greatly saves the hardware resources, if the gray scale value of the current sub-pixel and the gray scale value of the sub-pixel of the previous row are not found directly in the 9*9 gray scale lookup table, the initial gray scale value of the current sub-pixel can be calculated by a linear interpolation method. The linear interpolation method is an approximate calculation method basing on a set of known independent variable value of an unknown function, and its corresponding function value, by using of equal relationship to get the other value of the unknown function, and is a method of solving the approximation value of the position function.

The gray scale variation compensation value of the current sub-pixel is obtained by performing a calculating according to the initial gray scale value of the current sub-pixel and the gray scale value of the current sub-pixel. The calculation formula can be:

$$\Delta V=V2-V1$$

Wherein ΔV is the gray scale variation compensation value of the current sub-pixel, V2 is the initial gray scale value of the current sub-pixel, and V1 is the gray scale value of the current sub-pixel.

Step S130: obtaining an interval of the current sub-pixel located according to the abscissa value of the current sub-pixel and the coordinate values of each interval boundary line. In the present embodiment, step S130 includes: comparing the abscissa value of the current sub-pixel with the coordinate value of each interval boundary line, when the current sub-pixel is located between the boundary lines of two adjacent intervals, the current sub-pixel is in the interval between the boundary lines of two adjacent intervals.

Specifically, it is assumed that the current sub-pixel is in the interval between the boundary line of I interval and the boundary line of I+1 interval.

Figure 2:
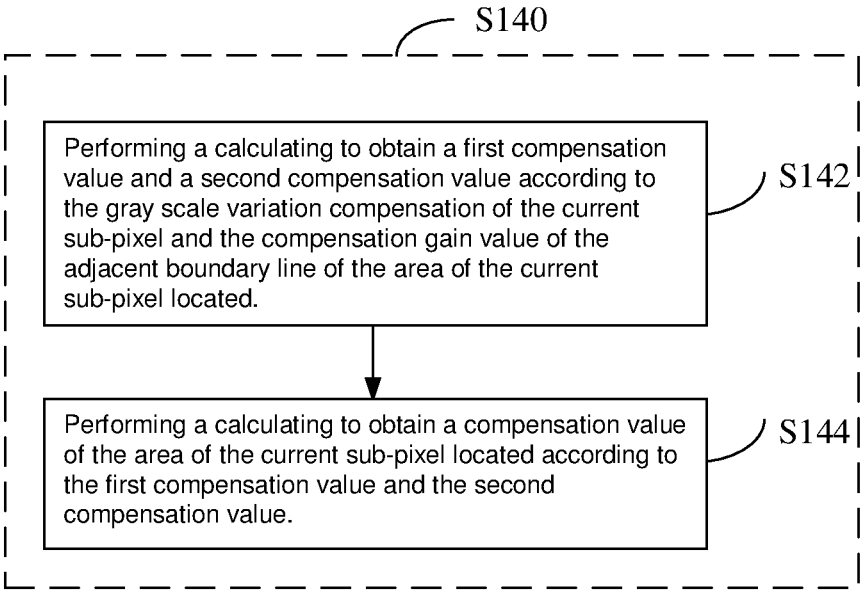
FIG. 2 is a flow chart of step S140 of FIG. 1.

Step S140: performing a calculating to obtain a compensation value of the interval of the current sub-pixel located according to the compensation gain value of the adjacent boundary lines of the interval of the current sub-pixel located and the gray scale variation compensation value of the current sub-pixel. In the present embodiment, as shown in FIG. 2, step S140 includes steps S142 and S144.

Step S142: performing a calculating to obtain a first compensation value and a second compensation value according to the gray scale variation compensation value of the current sub-pixel and the compensation gain value of the adjacent boundary lines of the interval of the current sub-pixel located. Specifically, the calculation formula can be:

$$\Delta Vi=\Delta V*Ai$$

$$\Delta V(i+1)=\Delta V*A(i+1)$$

Wherein ΔVi is the first compensation value, ΔV(i+1) is the second compensation value, ΔV is the gray scale variation compensation value of the current sub-pixel, Ai is the compensation gain value of the boundary line of I interval, A(i+1) is the compensation gain value of the boundary line of I+1 interval.

Step S144: performing a calculating to obtain a compensation value of the interval of the current sub-pixel located according to the first compensation value and the second compensation value. Specifically, the calculation formula can be:

$$\Delta Va=\Delta V(i+1)-\Delta Vi$$

Wherein ΔVa is the compensation value of the interval of the current sub-pixel located, ΔV(i+1) is the second compensation value, and ΔVi is the first compensation value.

Figure 3:
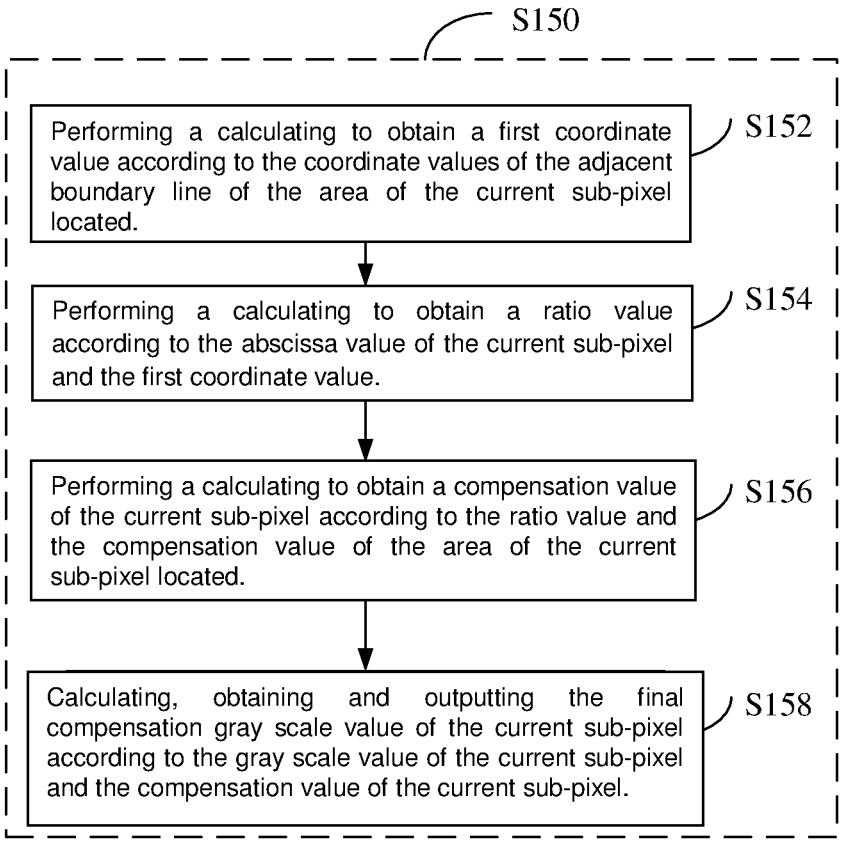
FIG. 3 is a flow chart of step S150 of FIG. 1.

Step S150: obtaining and outputting a final compensation gray scale value of the current sub-pixel by performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel. In the present embodiment, as shown in FIG. 3, step S150 includes steps S152 to S158.

Step S152: performing a calculating to obtain a first coordinate value according to the coordinate values of the adjacent boundary lines of the interval of the current sub-pixel located. Specifically, the calculation formula can be:

$$X=A+B$$

Wherein X is the first coordinate value, A is the coordinate value of the boundary line of I interval, and B is the coordinate value of the boundary line of I+1 interval.

Step S154: performing a calculating to obtain a ratio value according to the abscissa value of the current sub-pixel and the first coordinate value.

Specifically, the calculation formula can be:

$$Z=Y/X$$

Wherein Z is the ratio value, Y is the abscissa value of the current sub-pixel, and X is the first coordinate value.

Step S156: performing a calculating to obtain a compensation value of the current sub-pixel according to the ratio value and the compensation value of the interval of the current sub-pixel located. Specifically, the calculation formula can be:

$$\Delta V1=\Delta Va*Z$$

Wherein ΔV1 is the compensation value of the current sub-pixel, ΔVa is the compensation value of the interval of the current sub-pixel located, and Z is the ratio value.

Step S158: calculating, obtaining and outputting the final compensation gray scale value of the current sub-pixel according to the gray scale value of the current sub-pixel and the compensation value of the current sub-pixel. Specifically, the calculation formula can be:

$$\Delta V2=\Delta V1+V1$$

Wherein ΔV2 is the final compensation gray scale value of the current sub-pixel, ΔV1 is the compensation value of the current sub-pixel, and V1 is the gray scale value of the current sub-pixel.

The above-mentioned method for driving the display panel is mainly to improve the color shift caused by the pixel display matrix arrangement design of triple gate signal line, and mainly used in the field of thin film transistor liquid crystal display, TFT-LCD and active matrix organic light emitting diode, AMOLED display field, but not limited to the above two fields, according to the gray scale value of the current sub-pixel of the display panel and the gray scale value of the sub-pixel of the previous row of the display panel, performing a query in the gray scale lookup table, to obtain the initial gray scale value of the current sub-pixel, performing a calculating to obtain the gray scale variation compensation value of the current sub-pixel according to the initial gray scale value of the current sub-pixel and the gray scale value of the current sub-pixel, performing a calculating to obtain the compensation value of the located interval according to the compensation gain value of the adjacent boundary lines of the located interval and the gray scale variation compensation value of the current sub-pixel, and finally obtaining the compensation value of the current sub-pixel by performing the linear interpolation by performing the calculating to obtain the final compensation gray scale value of the current sub-pixel according to the gray scale value of the current sub-pixel and the compensation value of the current sub-pixel, in the premise of not increasing the cost, effectively improving the color shift, and enhancing the optical taste of the display device.

Figure 4:
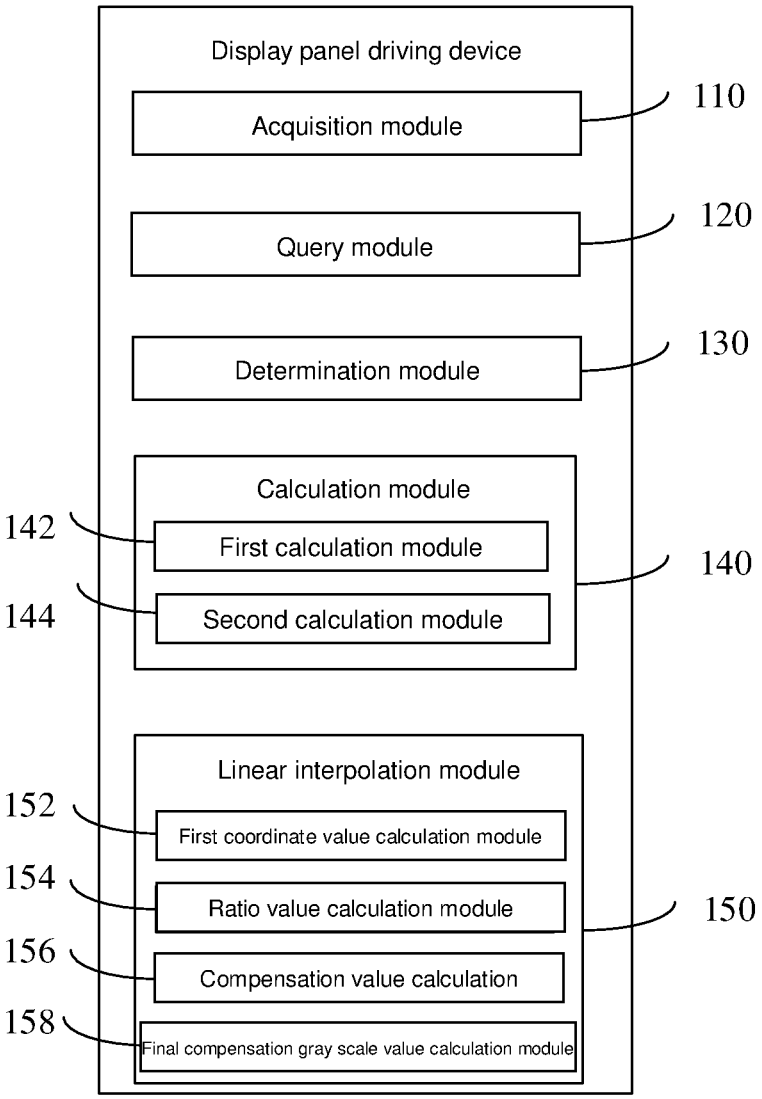
FIG. 4 is a schematic diagram of the driving device of the display panel provided in an embodiment.

In one embodiment, as shown in FIG. 4, a display panel driving device includes a storage module and a processing module, the storage module stores a computer executable instruction. The storage module includes an acquisition module 110, a query module 120, a determination module 130, a calculation module 140, and a linear interpolation module 150, when an executable instruction is executed by the processing module, making the processing module to execute the functions of the acquisition module 110, the query module 120, the determination module 130, the calculation module 140 and the linear interpolation module 150.

In one embodiment, the acquisition module 110 is configured to acquire the gray scale value of the current sub-pixel of the display panel, the abscissa value of the current sub-pixel, the compensation gain value for each interval boundary line, the coordinate value of the interval boundary line, and the gray scale value of the sub-pixel of the previous row of the display panel.

In one embodiment, the query module 120 is configured to perform the query in the gray scale lookup table, to obtain the initial gray scale value of the current sub-pixel, according to the gray scale value of the current sub-pixel of the display panel and the gray scale value of the sub-pixel of the previous row of the display panel, the gray scale variation compensation value of the current sub-pixel is calculated and obtained according to the initial gray scale value of the current sub-pixel and the gray scale value of the current sub-pixel. The calculation formula can be:

$$\Delta V=V2-V1$$

Wherein ΔV is the gray scale variation compensation value of the current sub-pixel, V2 is the initial gray scale value of the current sub-pixel, and V1 is the gray scale value of the current sub-pixel.

In one embodiment, the determination module 130 is configured to obtain the interval of the current sub-pixel located according to the abscissa value of the current sub-pixel and the coordinate values of each interval boundary line. In the present embodiment, the determination module 130 is configured to compare the abscissa value of the current sub-pixel with the coordinate value of each interval boundary line, when the current sub-pixel is located between the boundary lines of two adjacent intervals, the current sub-pixel is in the interval between the boundary lines of two adjacent intervals.

Specifically, it is assumed that the current sub-pixel is in the interval between the boundary line of I interval and the boundary line of I+1 interval.

In one embodiment, the calculation module 140 is configured to perform a calculating to obtain the compensation value of the interval of the current sub-pixel located according to the compensation gain value of the adjacent boundary lines of the interval of the current sub-pixel located and the gray scale variation compensation value of the current sub-pixel. In the present embodiment, the calculation module 140 includes a first calculation module 142 and a second calculation module 144.

The first calculation module 142 is configured to perform a calculating to obtain the first compensation value and the second compensation value according to the gray scale variation compensation value of the current sub-pixel and the compensation gain value of the adjacent boundary lines of the interval of the current sub-pixel located. The calculation formula can be:

$$\Delta Vi=\Delta V*Ai$$

$$\Delta V(i+1)=\Delta V*A(i+1)$$

Wherein ΔVi is the first compensation value, ΔV(i+1) is the second compensation value, ΔV is the gray scale variation compensation value of the current sub-pixel, Ai is the compensation gain value of the boundary line of I interval, A(i+1) is the compensation gain value of the boundary line of I+1 interval.

The second calculation module 142 is configured to perform a calculating to obtain the compensation value of the interval of the current sub-pixel located according to the first compensation value and the second compensation value. The calculation formula can be:

$$\Delta Va=\Delta V(i+1)-\Delta Vi$$

Wherein ΔVa is the compensation value of the interval of the current sub-pixel located, ΔV(i+1) is the second compensation value, and ΔVi is the first compensation value.

In one embodiment, the linear interpolation module 150 is configured to perform the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel to obtain and output the final compensation gray scale value of the current sub-pixel. In the present embodiment, the linear interpolation module 150 includes a first coordinate value calculation module 152, a ratio value calculation module 154, a compensation value calculation module 156, and a final compensation gray scale value calculation module 158.

The first coordinate value calculation module 152 is configured to perform a calculating to obtain the first coordinate value according to the coordinate values of the adjacent boundary lines of the interval of the current sub-pixel located. The calculation formula can be:

$$X=A+B$$

Wherein X is the first coordinate value, A is the coordinate value of the boundary line of I interval, and B is the coordinate value of the boundary line of I+1 interval.

The ratio value calculation module 154 is configured to perform a calculating to obtain the ratio value according to the abscissa value of the current sub-pixel and the first coordinate value. The calculation formula can be:

$$Z=Y/X$$

Wherein Z is the ratio value, Y is the abscissa value of the current sub-pixel, and X is the first coordinate value.

The compensation value calculation module 156 is configured to perform a calculating to obtain the compensation value of the current sub-pixel according to the ratio value and the compensation value of the interval of the current sub-pixel located. The calculation formula can be:

$$\Delta V1=\Delta Va*Z$$

Wherein ΔV1 is the compensation value of the current sub-pixel, ΔVa is the compensation value of the interval of the current sub-pixel located, and Z is the ratio value.

The final compensation gray scale value calculation module 158 is configured to calculate, obtain and output the final compensation gray scale value of the current sub-pixel according to the gray scale value of the current sub-pixel and the compensation value of the current sub-pixel. The calculation formula can be:

$$\Delta V2=\Delta V1+V1$$

Wherein ΔV2 is the final compensation gray scale value of the current sub-pixel, ΔV1 is the compensation value of the current sub-pixel, and V1 is the gray scale value of the current sub-pixel.

The above-mentioned display panel driving device is according to the gray scale value of the current sub-pixel of the display panel and the gray scale value of the sub-pixel of the previous row of the display panel, performing a query in the gray scale lookup table, to obtain the initial gray scale value of the current sub-pixel, performing a calculating to obtain the gray scale variation compensation value of the current sub-pixel according to the initial gray scale value of the current sub-pixel and the gray scale value of the current sub-pixel, performing a calculating to obtain the compensation value of the located interval according to the compensation gain value of the adjacent boundary lines of the located interval and the gray scale variation compensation value of the current sub-pixel, and finally obtaining the compensation value of the current sub-pixel by performing the linear interpolation by performing the calculating to obtain the final compensation gray scale value of the current sub-pixel according to the gray scale value of the current sub-pixel and the compensation value of the current sub-pixel, in the premise of not increasing the cost, effectively improving the color shift, and enhancing the optical taste of the display device.

Figure 5:
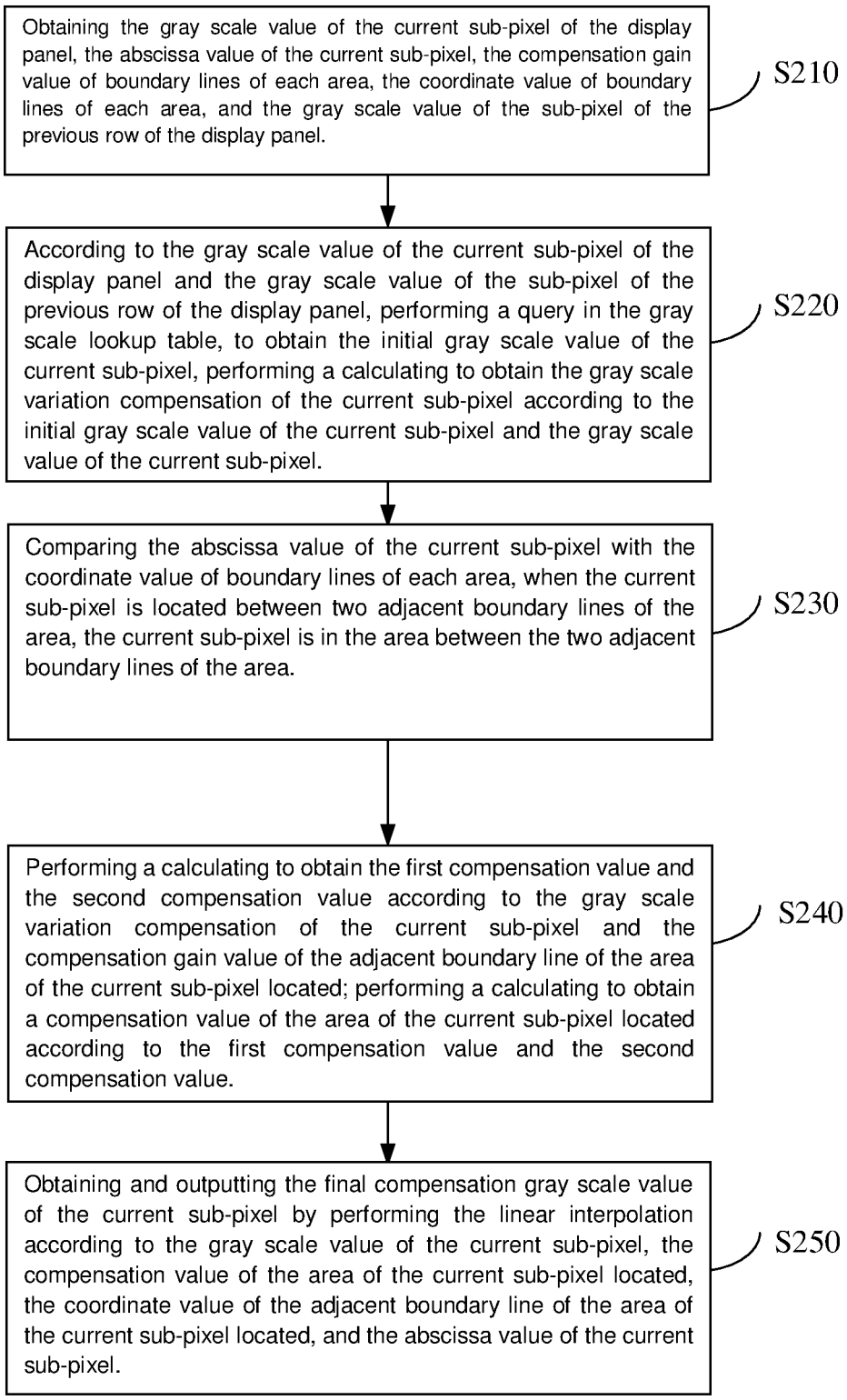
FIG. 5 is a flow chart of a method for driving the display panel provided by another embodiment.

In another embodiment, as shown in FIG. 5, a method for driving the display panel includes the steps of:

Step S210: Obtaining the gray scale value of the current sub-pixel of the display panel, the abscissa value of the current sub-pixel, the compensation gain value of each interval boundary line, the coordinate value of each interval boundary line, and the gray scale value of the sub-pixel of the previous row of the display panel.

Step S220: According to the gray scale value of the current sub-pixel of the display panel and the gray scale value of the sub-pixel of the previous row of the display panel, performing a query in the gray scale lookup table, to obtain the initial gray scale value of the current sub-pixel, performing a calculating to obtain the gray scale variation compensation value of the current sub-pixel according to the initial gray scale value of the current sub-pixel and the gray scale value of the current sub-pixel.

Specifically, the calculation formula can be:

$$\Delta V=V2-V1$$

Wherein ΔV is the gray scale variation compensation value of the current sub-pixel, V2 is the initial gray scale value of the current sub-pixel, and V1 is the gray scale value of the current sub-pixel.

Step S230: comparing the abscissa value of the current sub-pixel with the coordinate value of each interval boundary line, when the current sub-pixel is located between the boundary lines of two adjacent intervals, the current sub-pixel is in the interval between the boundary lines of two adjacent intervals.

Step S240: performing a calculating to obtain the first compensation value and the second compensation value according to the gray scale variation compensation value of the current sub-pixel and the compensation gain value of the adjacent boundary lines of the interval of the current sub-pixel located; performing a calculating to obtain a compensation value of the interval of the current sub-pixel located according to the first compensation value and the second compensation value.

Specifically, the calculation formula of performing a calculating to obtain the first compensation value and the second compensation value according to the gray scale variation compensation value of the current sub-pixel and the compensation gain value of the adjacent boundary lines of the interval of the current sub-pixel located in step S240 can be:

$$\Delta Vi=\Delta V*Ai$$

$$\Delta V(i+1)=\Delta V*A(i+1)$$

Wherein ΔVi is the first compensation value, ΔV(i+1) is the second compensation value, ΔV is the gray scale variation compensation value of the current sub-pixel, Ai is the compensation gain value of the boundary line of I interval, A(i+1) is the compensation gain value of the boundary line of I+1 interval.

The calculation formula of performing a calculating to obtain a compensation value of the interval of the current sub-pixel located according to the first compensation value and the second compensation value in step S240 can be:

$$\Delta Va=\Delta V(i+1)-\Delta Vi$$

Wherein ΔVa is the compensation value of the interval of the current sub-pixel located, ΔV(i+1) is the second compensation value, and ΔVi is the first compensation value.

Step S250: obtaining and outputting the final compensation gray scale value of the current sub-pixel by performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel.

Specifically, step S250 includes steps S252 to S258.

Step S252: performing a calculating to obtain the first coordinate value according to the coordinate values of the adjacent boundary lines of the interval of the current sub-pixel located. Specifically, the calculation formula can be:

$$X=A+B$$

Wherein X is the first coordinate value, A is the coordinate value of the boundary line of I interval, and B is the coordinate value of the boundary line of I+1 interval.

Step S254: performing a calculating to obtain the ratio value according to the abscissa value of the current sub-pixel and the first coordinate value.

Specifically, the calculation formula can be:

$$Z=Y/X$$

Wherein Z is the ratio value, Y is the abscissa value of the current sub-pixel, and X is the first coordinate value.

Step S256: performing a calculating to obtain the compensation value of the current sub-pixel according to the ratio value and the compensation value of the interval of the current sub-pixel located. Specifically, the calculation formula can be:

$$\Delta V1=\Delta Va*Z$$

Wherein ΔV1 is the compensation value of the current sub-pixel, ΔVa is the compensation value of the interval of the current sub-pixel located, and Z is the ratio value.

Step S258: calculating, obtaining and outputting the final compensation gray scale value of the current sub-pixel according to the gray scale value of the current sub-pixel and the compensation value of the current sub-pixel. Specifically, the calculation formula can be:

$$\Delta V2=\Delta V1+V1$$

Wherein ΔV2 is the final compensation gray scale value of the current sub-pixel, ΔV1 is the compensation value of the current sub-pixel, and V1 is the gray scale value of the current sub-pixel.

The above-mentioned method for driving the display panel is according to the gray scale value of the current sub-pixel of the display panel and the gray scale value of the sub-pixel of the previous row of the display panel, performing a query in the gray scale lookup table, to obtain the initial gray scale value of the current sub-pixel, performing a calculating to obtain the gray scale variation compensation value of the current sub-pixel according to the initial gray scale value of the current sub-pixel and the gray scale value of the current sub-pixel, performing a calculating to obtain the compensation value of the located interval according to the compensation gain value of the adjacent boundary lines of the located interval and the gray scale variation compensation value of the current sub-pixel, and finally obtaining the compensation value of the current sub-pixel by performing the linear interpolation by performing the calculating to obtain the final compensation gray scale value of the current sub-pixel according to the gray scale value of the current sub-pixel and the compensation value of the current sub-pixel, in the premise of not increasing the cost, effectively improving the color shift, and enhancing the optical taste of the display device.

Figure 6:
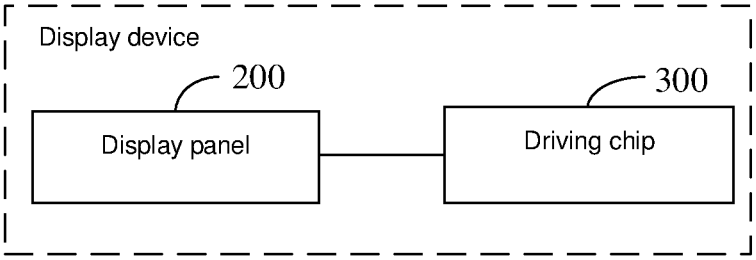
FIG. 6 is a schematic diagram of a display device provided in an embodiment.

In one embodiment, as shown in FIG. 6, a display device includes a display panel 200 and a driving chip 300 performing the methods for driving the display panel of any one of the method described above, the driving chip 300 is electrically connected to the display panel 200.

Specifically, the driving chip 300 is mounted on the display panel 200, in the premise of not increasing the cost, effectively improving the color shift, and enhancing the optical taste of the display device 200.

Wherein the display panel may be, for example, an LCD display panel, an OLED display panel, a QLED display panel, a curved-surface display panel, or other display panel.

In one embodiment, one or more non-volatile computer readable storage medium storing computer executable instructions, when the computer executable instructions are executed by one or more processing modules, making the one or more processing modules to perform the following step: obtaining the gray scale value of the current sub-pixel of the display panel, the abscissa value of the current sub-pixel, the compensation gain value of each interval boundary line, the coordinate value of each interval boundary line, and the gray scale value of the sub-pixel of the previous row of the display panel; according to the gray scale value of the current sub-pixel of the display panel and the gray scale value of the sub-pixel of the previous row of the display panel, performing a query in a gray scale lookup table, to obtain an initial gray scale value of the current sub-pixel, performing a calculating to obtain a gray scale variation compensation value of the current sub-pixel according to the initial gray scale value of the current sub-pixel and the gray scale value of the current sub-pixel; obtaining an interval of the current sub-pixel located according to the abscissa value of the current sub-pixel and the coordinate values of each interval boundary line; performing a calculating to obtain a compensation value of the interval of the current sub-pixel located according to the compensation gain value of the adjacent boundary lines of the interval of the current sub-pixel located and the gray scale variation compensation value of the current sub-pixel; and obtaining and outputting a final compensation gray scale value of the current sub-pixel according to performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel.

In one embodiment, one or more non-volatile computer readable storage medium storing computer executable instructions, when the computer executable instructions are executed by one or more processing modules, making the one or more processing modules to perform the following step: obtaining the gray scale value of the current sub-pixel of the display panel, the abscissa value of the current sub-pixel, the compensation gain value of each interval boundary line, the coordinate value of each interval boundary line, and the gray scale value of the sub-pixel of the previous row of the display panel; according to the gray scale value of the current sub-pixel of the display panel and the gray scale value of the sub-pixel of the previous row of the display panel, performing a query in a gray scale lookup table, to obtain an initial gray scale value of the current sub-pixel, performing a calculating to obtain a gray scale variation compensation value of the current sub-pixel according to the initial gray scale value of the current sub-pixel and the gray scale value of the current sub-pixel; comparing the abscissa value of the current sub-pixel with the coordinate value of each interval boundary line, when the current sub-pixel is located between the boundary lines of two adjacent intervals, the current sub-pixel is in the interval between the boundary lines of two adjacent intervals s; performing a calculating to obtain the first compensation value and the second compensation value according to the gray scale variation compensation value of the current sub-pixel and the compensation gain value of the adjacent boundary lines of the interval of the current sub-pixel located; performing a calculating to obtain the compensation value of the interval of the current sub-pixel located according to the first compensation value and the second compensation value; and obtaining and outputting the final compensation gray scale value of the current sub-pixel by performing the linear interpolation according to the gray scale value of the current sub-pixel, the compensation value of the interval of the current sub-pixel located, the coordinate value of the adjacent boundary lines of the interval of the current sub-pixel located, and the abscissa value of the current sub-pixel.

It will be understood by those of ordinary skill in the art that implementing all or part of the processes in the method of the embodiments described above may be accomplished by a computer program to instruct the associated hardware, the programs may be stored in a computer readable storage medium, when the programs are in executed, the flow of embodiments of the various methods described above may be included. Wherein the storage medium may be a magnetic disk, an optical disk, a read-only memory, ROM, a random-access memory, RAM, or the like.

The technical features of the embodiments described above can be arbitrarily combined, and in order to make the description simple, all possible combinations of the respective technical features in the above embodiments are not described. However, as long as there is no contradiction in the combination of these technical features, should be considered as the scope of this manual.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A method for driving a display panel, comprising the steps of:

obtaining a gray scale value of a current sub-pixel of a display panel, an abscissa value of the current sub-pixel, compensation gain values of boundary lines of each interval, coordinate values of the boundary lines of each interval, and a gray scale value of a sub-pixel of a previous row of the display panel;

performing a query in a gray scale lookup table according to the gray scale value of the current sub-pixel of the display panel and the gray scale value of the sub-pixel of the previous row of the display panel to obtain an initial gray scale value of the current sub-pixel, performing a calculation to obtain a gray scale variation compensation value of the current sub-pixel according to the initial gray scale value of the current sub-pixel and the gray scale value of the current sub-pixel;

obtaining an interval of the current sub-pixel location according to the abscissa value of the current sub-pixel and the coordinate values of boundary lines of each interval;

performing a calculation to obtain a compensation value of the interval of the current sub-pixel location according to the compensation gain value of adjacent boundary lines of the interval of the current sub-pixel location and the gray scale variation compensation value of the current sub-pixel; and obtaining and outputting a final compensation gray scale value of the current sub-pixel by performing a linear interpolation according to the gray scale value of the current sub-pixel, the compensation value of the interval of the current sub-pixel location, the coordinate value of the adjacent boundary lines of the interval of the current sub-pixel location, and the abscissa value of the current sub-pixel.

2. The method for driving the display panel according to claim 1, wherein the step of performing the calculation to obtain the gray scale variation compensation value of the current sub-pixel according to the initial gray scale value of the current sub-pixel and the gray scale value of the current sub-pixel specifically is:

$$\Delta V = V2 - V1; \text{ and}$$

wherein ΔV is the gray scale variation compensation value of the current sub-pixel, V2 is the initial gray scale value of the current sub-pixel, and V1 is the gray scale value of the current sub-pixel.

3. The method for driving the display panel according to claim 1, wherein the step of obtaining the interval of the current sub-pixel location according to the abscissa value of the current sub-pixel and the coordinate values of the boundary lines of each interval further comprises:

comparing the abscissa value of the current sub-pixel with the coordinate values of the boundary lines of each interval, when the current sub-pixel is located between the boundary lines of two adjacent intervals, the current sub-pixel is located in the interval between the boundary lines of two adjacent intervals.

4. The method for driving the display panel according to claim 1, wherein the step of performing the calculation to obtain the compensation value of the interval of the current sub-pixel location according to the compensation gain value of the adjacent boundary lines of the interval of the current sub-pixel location, and the gray scale variation compensation value of the current sub-pixel further comprises:

performing a calculation to obtain a first compensation value and a second compensation value according to the gray scale variation compensation value of the current sub-pixel and the compensation gain value of the adjacent boundary lines of the interval of the current sub-pixel location; and performing a calculation to obtain the compensation value of the interval of the current sub-pixel location according to the first compensation value and the second compensation value.

5. The method for driving the display panel according to claim 4, wherein the step of performing the calculation to obtain the first compensation value and the second compensation value according to the gray scale variation compensation value of the current sub-pixel and the compensation gain value of the adjacent boundary lines of the interval of the current sub-pixel location specifically is:

$$\Delta Vi = \Delta V * Ai;$$

$$\Delta V(i+1) = \Delta V * A(i+1); \text{ and}$$

wherein ΔVi is the first compensation value, ΔV(i+1) is the second compensation value, ΔV is the gray scale variation compensation value of the current sub-pixel, Ai is the compensation gain value of the boundary line of I interval, A(i+1) is the compensation gain value of the boundary line of I+1 interval.

6. The method for driving the display panel according to claim 4, wherein the step of performing the calculation to obtain the compensation value of the interval of the current sub-pixel location according to the first compensation value and the second compensation value specifically is:

$$\Delta Va = \Delta V(i+1) - \Delta Vi; \text{ and}$$

wherein ΔVa is the compensation value of the interval of the current sub-pixel location, ΔV(i+1) is the second compensation value, and ΔVi is the first compensation value.

7. The method for driving the display panel according to claim 1, wherein the step of obtaining and outputting the final compensation gray scale value of the current sub-pixel by performing the linear interpolation according to the gray scale value of the current sub-pixel, the compensation value of the interval of the current sub-pixel location, the coordinate value of the adjacent boundary lines of the interval of the current sub-pixel location, and the abscissa value of the current sub-pixel further comprises:

performing a calculation to obtain a first coordinate value according to the coordinate values of the adjacent boundary lines of the interval of the current sub-pixel location;

performing a calculation to obtain a ratio value according to the abscissa value of the current sub-pixel and the first coordinate value;

performing a calculation to obtain a compensation value of the current sub-pixel according to the ratio value and the compensation value of the interval of the current sub-pixel location; and performing a calculation to obtain and output the final compensation gray scale value of the current sub-pixel according to the gray scale value of the current sub-pixel and the compensation value of the current sub-pixel.

8. The method for driving the display panel according to claim 7, wherein the step of performing the calculation to obtain the first coordinate value according to the coordinate values of the adjacent boundary lines of the interval of the current sub-pixel location specifically is:

$$X=A+B;\text{ and}$$

wherein X is the first coordinate value, A is the coordinate value of the boundary line of I interval, and B is the coordinate value of the boundary line of I+1 interval.

9. The method for driving the display panel according to claim 7, wherein the step of performing the calculation to obtain the ratio value according to the abscissa value of the current sub-pixel and the first coordinate value further comprises:

$$Z=Y/X;\text{ and}$$

wherein Z is the ratio value, Y is the abscissa value of the current sub-pixel, and X is the first coordinate value.

10. The method for driving the display panel according to claim 7, wherein the step of performing the calculation to obtain the compensation value of the current sub-pixel according to the ratio value and the compensation value of the interval of the current sub-pixel location specifically is:

$$\Delta V1=\Delta Va*Z;\text{ and}$$

wherein ΔV1 is the compensation value of the current sub-pixel, ΔVa is the compensation value of the interval of the current sub-pixel location, and Z is the ratio value.

11. The method for driving the display panel according to claim 7, wherein the step of performing the calculation to obtain and output the final compensation gray scale value of the current sub-pixel according to the gray scale value of the current sub-pixel and the compensation value of the current sub-pixel specifically is:

$$\Delta V2=\Delta V1+V1;\text{ and}$$

wherein ΔV2 is the final compensation gray scale value of the current sub-pixel, ΔV1 is the compensation value of the current sub-pixel, and V1 is the gray scale value of the current sub-pixel.

12. A display panel driving device, comprising:

a memory storing a computer executable instruction, and a processor; wherein the processor executes the computer executable instruction that performs a method comprising:

obtaining a gray scale value of a current sub-pixel of a display panel, an abscissa value of the current sub-pixel, compensation gain values of boundary lines of each interval, coordinate values of the boundary lines of each interval, and a gray scale value of a sub-pixel of a previous row of the display panel;

performing a query in a gray scale lookup table to obtain an initial gray scale value of the current sub-pixel according to the gray scale value of the current sub-pixel of the display panel and the gray scale value of the sub-pixel of the previous row of the display panel, and performing a calculation to obtain a gray scale variation compensation value of the current sub-pixel according to the initial gray scale value of the current sub-pixel and the gray scale value of the current sub-pixel;

obtaining an interval of the current sub-pixel location according to the abscissa value of the current sub-pixel and the coordinate values of the boundary lines of each interval;

performing a calculation to obtain a compensation value of the interval of the current sub-pixel location according to the compensation gain value of adjacent boundary lines of the interval of the current sub-pixel location and the gray scale variation compensation value of the current sub-pixel; and obtaining and outputting a final compensation gray scale value of the current sub-pixel by performing a linear interpolation according to the gray scale value of the current sub-pixel, the compensation value of the interval of the current sub-pixel location, the coordinate values of the adjacent boundary lines of the interval of the current sub-pixel location, and the abscissa value of the current sub-pixel.

13. The device according to claim 12, wherein the step of obtaining an interval of the current sub-pixel location according to the abscissa value of the current sub-pixel and the coordinate values of the boundary lines of each interval comprises:

comparing the abscissa value of the current sub-pixel with the coordinate values of the boundary lines of each interval, when the current sub-pixel is located between the boundary lines of two adjacent intervals, the current sub-pixel is located in the interval between the boundary lines of two adjacent intervals.

14. The device according to claim 12, wherein the step of performing a calculation to obtain a compensation value of the interval of the current sub-pixel location according to the compensation gain value of the adjacent boundary lines of the interval of the current sub-pixel location and the gray scale variation compensation value of the current sub-pixel comprises:

performing a calculation to obtain a first compensation value and a second compensation value according to the gray scale variation compensation value of the current sub-pixel and the compensation gain value of the adjacent boundary lines of the interval of the current sub-pixel location; and performing a calculation to obtain the compensation value of the interval of the current sub-pixel location according to the first compensation value and the second compensation value.

15. The device according to claim 12, wherein the step of obtaining and outputting a final compensation gray scale value of the current sub-pixel by performing a linear interpolation according to the gray scale value of the current sub-pixel, the compensation value of the interval of the current sub-pixel location, the coordinate value of the adjacent boundary lines of the interval of the current sub-pixel location, and the abscissa value of the current sub-pixel to obtain and output the final compensation gray scale value of the current sub-pixel comprises:

performing a calculation to obtain a first coordinate value according to the coordinate values of the adjacent boundary lines of the interval of the current sub-pixel location;

performing a calculation to obtain a ratio value according to the abscissa value of the current sub-pixel and the first coordinate value;

performing a calculation to obtain a compensation value of the current sub-pixel according to the ratio value and the compensation value of the interval of the current sub-pixel location; and performing a calculation to obtain and output the final compensation gray scale value of the current sub-pixel according to the gray scale value of the current sub-pixel and the compensation value of the current sub-pixel.

16. A method for driving a display panel, comprising the steps of:

obtaining a gray scale value of a current sub-pixel of a display panel, an abscissa value of the current sub-pixel, compensation gain values of boundary lines of each interval, coordinate values of the boundary lines of each interval, and a gray scale value of a sub-pixel of a previous row of the display panel;

performing a query in a gray scale lookup table according to the gray scale value of the current sub-pixel of the display panel and the gray scale value of the sub-pixel of the previous row of the display panel to obtain an initial gray scale value of the current sub-pixel, performing a calculation to obtain a gray scale variation compensation value of the current sub-pixel according to the initial gray scale value of the current sub-pixel and the gray scale value of the current sub-pixel;

comparing the abscissa value of the current sub-pixel with the coordinate values of the boundary lines of each interval, when the current sub-pixel located between the boundary lines of two adjacent intervals, the current sub-pixel disposed in the interval between the boundary lines of two adjacent intervals;

performing a calculation to obtain a first compensation value and a second compensation value according to the gray scale variation compensation value of the current sub-pixel and the compensation gain value of adjacent boundary lines of the interval of the current sub-pixel location; and obtaining and outputting a final compensation gray scale value of the current sub-pixel by performing a linear interpolation according to the gray scale value of the current sub-pixel, the compensation value of the interval of the current sub-pixel location, the coordinate value of the adjacent boundary lines of the interval of the current sub-pixel location, and the abscissa value of the current sub-pixel.

17. The method for driving the display panel according to claim 16, wherein the step of obtaining and outputting the final compensation gray scale value of the current sub-pixel by performing the linear interpolation according to the gray scale value of the current sub-pixel, the compensation value of the interval of the current sub-pixel location, the coordinate value of the adjacent boundary lines of the interval of the current sub-pixel location, and the abscissa value of the current sub-pixel comprises:

performing a calculation to obtain a first coordinate value according to the coordinate values of the adjacent boundary lines of the interval of the current sub-pixel location;

performing a calculation to obtain a ratio value according to the abscissa value of the current sub-pixel and the first coordinate value;

performing a calculation to obtain a compensation value of the current sub-pixel according to the ratio value and the compensation value of the interval of the current sub-pixel location; and performing a calculation to obtain and output the final compensation gray scale value of the current sub-pixel according to the gray scale value of the current sub-pixel and the compensation value of the current sub-pixel.

18. The method for driving the display panel according to claim 16, wherein the step of performing the calculation to obtain the first coordinate value according to the coordinate values of the adjacent boundary lines of the interval of the current sub-pixel location specifically is:

$X=A+B$; and wherein X is the first coordinate value, A is the coordinate value of the boundary line of I interval, and B is the coordinate value of the boundary line of I+1 interval.

19. The method for driving the display panel according to claim 16, wherein the step of performing the calculation to obtain the ratio value according to the abscissa value of the current sub-pixel and the first coordinate value specifically is:

$Z=Y/X$; and wherein Z is the ratio value, Y is the abscissa value of the current sub-pixel, and X is the first coordinate value.

20. The method for driving the display panel according to claim 16, wherein the step of performing the calculation to obtain the compensation value of the current sub-pixel according to the ratio value and the compensation value of the interval of the current sub-pixel location specifically is:

$\Delta V1=\Delta Va*Z$; and wherein ΔV1 is the compensation value of the current sub-pixel, ΔVa is the compensation value of the interval of the current sub-pixel location, and Z is the ratio value.

* * * * *